US008375489B2

(12) United States Patent
Manouchehri

(10) Patent No.: US 8,375,489 B2
(45) Date of Patent: Feb. 19, 2013

(54) HOSPITAL CHAIR BEDS WITH DROP FOOT SECTION

(75) Inventor: Nikon Manouchehri, Charleston, SC (US)

(73) Assignee: Piedmont 361, LLC, Dobson, NC (US)

( * ) Notice: Subject to any disclaimer, the term of this patent is extended or adjusted under 35 U.S.C. 154(b) by 707 days.

(21) Appl. No.: 12/499,896

(22) Filed: Jul. 9, 2009

(65) Prior Publication Data

US 2010/0005591 A1 Jan. 14, 2010

Related U.S. Application Data

(60) Provisional application No. 61/079,247, filed on Jul. 9, 2008.

(51) Int. Cl.
*A47B 7/02* (2006.01)
*A47B 71/00* (2006.01)
*A47B 7/00* (2006.01)

(52) U.S. Cl. ..... 5/618; 5/600; 5/613; 5/616; 5/617

(58) Field of Classification Search ..... 5/600, 612, 5/613, 616, 617, 618
See application file for complete search history.

(56) References Cited

U.S. PATENT DOCUMENTS

| | | | | |
|---|---|---|---|---|
| 5,497,518 | A * | 3/1996 | Iura | 5/618 |
| 2006/0236458 | A1 * | 10/2006 | Barthelt | 5/613 |
| 2007/0017029 | A1 * | 1/2007 | Wurdeman | 5/618 |

FOREIGN PATENT DOCUMENTS

| | | | |
|---|---|---|---|
| EP | 0596 115 | A1 | 5/1992 |
| GB | 2 223 936 | A | 4/1990 |
| WO | WO 2007/146467 | A1 | 12/2007 |

OTHER PUBLICATIONS

Notification of Transmittal of the International Search Report and the Written Opinion of the International Searching Authority issued by the European Patent Office on Oct. 23, 2009 for the corresponding PCT Application No. PCT/US2009/004010.

Med Mizer®: Pivot-Rehab 1000™; Brochure—4 pages; http://www.med-mizer.com/wp-content/uploads/2011/03/Med-MizerPR1000.pdf.

* cited by examiner

*Primary Examiner* — Jonathan Liu
(74) *Attorney, Agent, or Firm* — Myers Bigel Sibley & Sajovec, P.A.

(57) ABSTRACT

A hospital bed convertible to a side egress chair bed includes a base having opposite end portions; a lifting mechanism secured to the base between the end portions; a rotating frame mounted on the lifting mechanism and configured to rotate horizontally relative to the base; and a patient support surface pivotally secured to the rotating frame. The patient support surface includes a back panel, a seat panel, and a leg panel that are configured to articulate relative to each other from a co-planar configuration to a chair configuration. The leg panel includes a first section pivotally connected to the seat panel and a second section that is separable from the leg panel first section.

17 Claims, 17 Drawing Sheets

HOSPITAL CHAIR BEDS WITH DROP FOOT SECTION

RELATED APPLICATION

This application claims the benefit of and priority to U.S. Provisional Patent Application No. 61/079,247, filed Jul. 9, 2008, the disclosure of which is incorporated herein by reference as if set forth in its entirety.

FIELD OF THE INVENTION

The present invention relates generally to the field of hospital beds and, more specifically, to hospital beds that are convertible into a chair configuration.

BACKGROUND OF THE INVENTION

Conventional hospital beds are configured to provide a sufficiently comfortable support surface for patients in a supine position. In many cases, it is desirable for patients to elevate from a supine position to a sitting position in order to increase the activity of the circulatory and cardiovascular systems and/or in the course of medical treatment. In addition, patients may be interested in sitting up in bed to be more comfortable, for example, in order to read or meet with visitors. However, it may be difficult for some patients to get out of a hospital bed. As such, hospital beds that can be converted into chair-like configurations have been developed. In addition, hospital beds that can assist patients in moving from a supine position to a sitting position for the purpose of achieving a standing or walking position have also been developed.

SUMMARY

According to some embodiments of the present invention, a hospital bed includes a base comprising opposite end portions; a lifting mechanism, such as a scissors lift, secured to the base between the end portions; a rotating frame mounted on the lifting mechanism that is configured to rotate horizontally relative to the base; and a patient support surface pivotally secured to the rotating frame. The patient support surface includes a back panel, a seat panel, and a leg panel that are configured to articulate relative to each other from a co-planar configuration to a chair configuration. The articulated support surface is configured to translate to a side-egress chair configuration. In some embodiments, the seat panel is tilted downward at about 30 degrees while the back panel is substantially vertical when in a side-egress chair configuration.

In some embodiments, the leg panel includes a first section pivotally connected to the seat panel and a second section that is removable from the leg panel first section prior to articulating the support surface.

In other embodiments, the hospital bed includes a foot board secured to an end portion of the base. The leg panel second section is pivotally connected to the foot board and is configured to pivot downwardly away from the leg panel first section prior to articulating the support surface.

The leg panel first and second sections have respective first and second lengths. In some embodiments, the first length is less than the second length. In other embodiments, the first length is greater than or equal to the second length.

In some embodiments, the bed can include a first pair of side rails and a second pair of side rails longitudinally spaced apart from the first pair of side rails. Each side rail can be movably mounted to the bed with the first pair residing on opposing sides of the back panel and the second pair residing on opposing sides of the leg section, with the second pair configured to reside substantially vertically when the bed is in the side-egress chair configuration.

Still other embodiments are directed to methods of operating a hospital bed. The methods include articulating back, seat and leg panels of a patient support surface relative to each other from a substantially co-planar configuration to a chair configuration, wherein the leg panel includes a first section pivotally connected to the seat panel and a second section that is removable from the leg panel first section; separating the leg panel second section from the leg panel first section; and then rotating the back, seat and leg panel first section 90 degrees to a side egress position. The methods may also include titling the seat section downward about 30 degrees while the back section is substantially vertical to move the bed to a stand-assist side egress configuration. The methods may also include rotating patient side rails with the back panel, seat panel and leg panel first section then tilting the patient side rails down toward a floor. In some embodiments, separating the leg panel second section from the leg panel first section may include pivoting the leg panel second section downwardly away from the leg panel first section.

BRIEF DESCRIPTION OF THE DRAWINGS

The accompanying drawings, which form a part of the specification, illustrate embodiments of the present invention. The drawings and description together serve to fully explain the invention.

DETAILED DESCRIPTION

Figure 1:
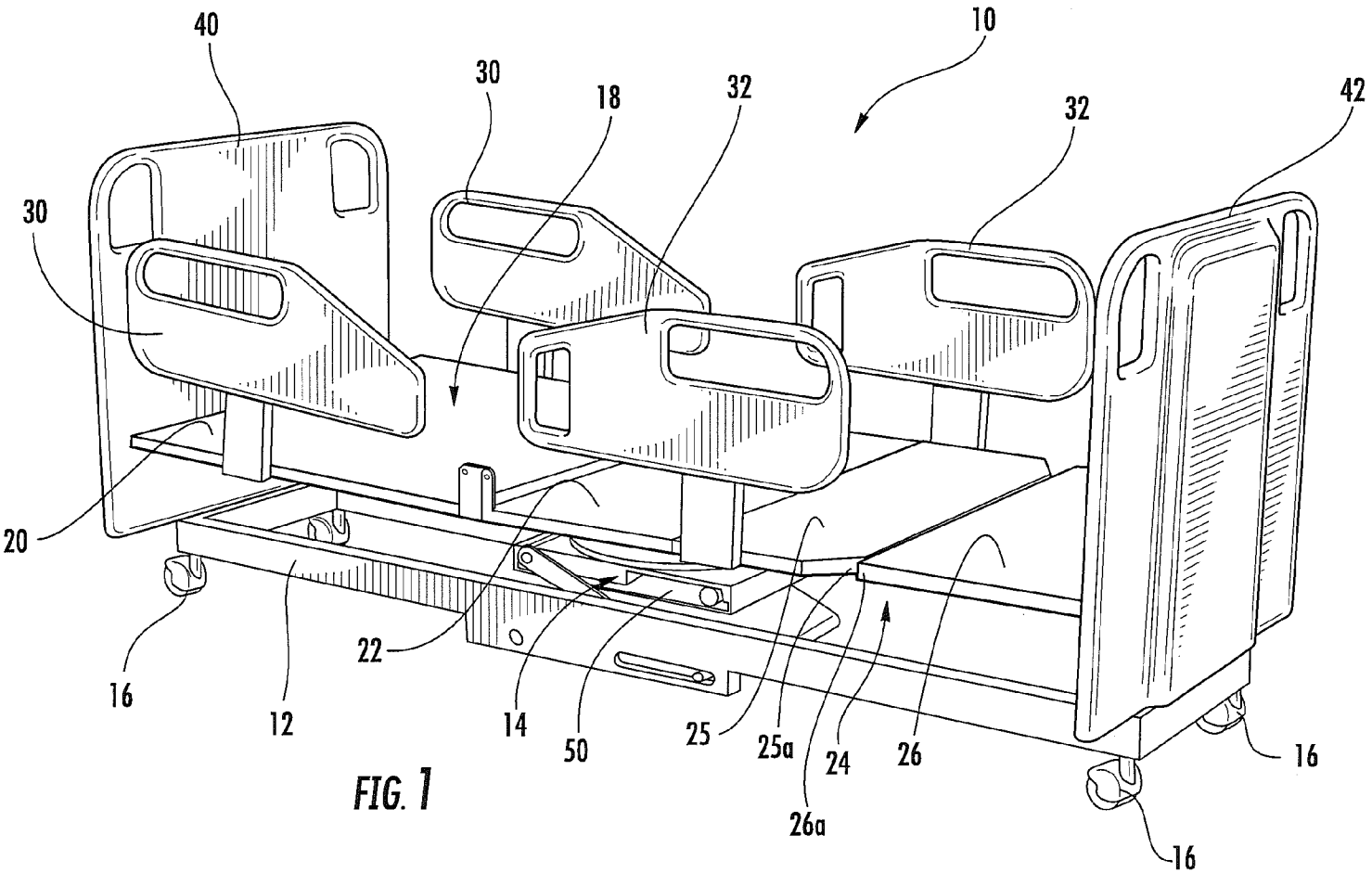
FIG. 1 is a side perspective view of a hospital chair bed in the bed configuration, according to some embodiments of the present invention.

While the invention is susceptible to various modifications and alternative forms, specific embodiments thereof are shown by way of example in the drawings and will herein be described in detail. It should be understood, however, that there is no intent to limit the invention to the particular forms disclosed, but on the contrary, the invention is to cover all modifications, equivalents, and alternatives falling within the spirit and scope of the invention as defined by the claims. Like reference numbers signify like elements throughout the description of the figures.

As used herein, the singular forms "a," "an," and "the" are intended to include the plural forms as well, unless expressly stated otherwise. It should be further understood that the terms "comprises" and/or "comprising" when used in this specification are taken to specify the presence of stated features, steps, operations, elements, and/or components, but do not preclude the presence or addition of one or more other features, steps, operations, elements, components, and/or groups thereof. As used herein, the term "and/or" includes any and all combinations of one or more of the associated listed items.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

In the drawings, the thickness of lines, layers and regions may be exaggerated for clarity. It will be understood that when an element is referred to as being "on", "attached" to, "connected" to, "coupled" with, "contacting", etc., another element, it can be directly on, attached to, connected to, coupled with or contacting the other element or intervening elements may also be present. In contrast, when an element is referred to as being, for example, "directly on", "directly attached" to, "directly connected" to, "directly coupled" with or "directly contacting" another element, there are no intervening elements present. It will also be appreciated by those of skill in the art that references to a structure or feature that is disposed "adjacent" another feature may have portions that overlap or underlie the adjacent feature.

Spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of a device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of "over" and "under". A device may be otherwise oriented (rotated 90 degrees or at other orientations) and the spatially relative descriptors used herein interpreted accordingly. Similarly, the terms "upwardly", "downwardly", "vertical", "horizontal" and the like are used herein for the purpose of explanation only unless specifically indicated otherwise.

It will be understood that, although the terms "first", "second", etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a "first" element, component, region, layer or section discussed below could also be termed a "second" element, component, region, layer or section without departing from the teachings of the present invention.

The term "hospital bed" is used broadly herein to refer to a bed for persons in whatever environment the bed is used and is not limited to use in a hospital per se (e.g., a hospital bed may be used in a private home, nursing home, rehab center, short term or long term care facility, outpatient treatment center and the like).

Referring to FIGS. 1-11, a hospital bed 10, according to some embodiments of the present invention, is illustrated. The illustrated bed 10 has a base 12 and a rotating frame 14 mounted on the base 12. The frame 14 is configured to rotate relative to the base 12 to facilitate side egress from the bed 10 by a patient, as will be described below. Casters 16 are mounted to the four corners of the base 12 and facilitate movement of the bed 10 about the hospital (or other facility). In some embodiments, casters 16 are locking casters that can be selectively locked to prevent movement of the bed 10.

The illustrated bed 10 has a patient support surface 18 configured to support a mattress (not illustrated) on which a patient is situated. The patient support surface 18 is supported by the rotating frame 14 and includes a back panel 20, a seat panel 22, and a leg panel 24 serially hinged together. Each panel is pivotally attached to the adjoining panel by pins, hinges, or other suitable mechanisms that allow articulation, well known in the art. The various panels of the patient support surface 18 may include a supporting frame and/or other structural elements therebeneath, as would be understood by one skilled in the art of the present invention. The illustrated panels of the patient support surface 18 in FIGS. 1-11 are not illustrated with any supporting frames or other structure to simplify the understanding of the operation of the patient support surface 18 and for illustrative convenience.

The bed 10 has patient side rails 30 secured to the back panel 20 in spaced-apart relationship and patient side rails 32 typically secured to the leg panel 24 in spaced-apart relationship, as illustrated. A head board is 40 is secured to the base 12 at the head end of the bed 10 and a foot board 42 is secured to the base 12 at the foot end of the bed 10, as illustrated.

The patient support surface 18 can be secured to the rotating frame 14 via a pin connection (not illustrated) to facilitate tilting of the patient support surface 18 relative to the rotating frame 14. Embodiments of the present invention are not limited to a pin connection. Various other types of connections that facilitate pivotal movement of the patient support surface 18 can be utilized. The rotating frame 14 is secured to the base 12 via a lift mechanism 50, such as a scissors lift or other known device. The lift mechanism 50 is configured to raise and lower the patient support surface, via the rotating frame 14, relative to the base 12. The lift mechanism 50 can be driven by hydraulics cylinders, air cylinders, air bags, and/or electrical devices, etc. The lift mechanism 50 can be configured to allow the patient support surface 18 to be raised very high relative to the base 12 and to be lowered very low with respect to the base 12.

The illustrated leg panel 24 includes a first section 25 hingedly connected to the seat panel 22 and a second section 26 pivotally and vertically coupled to the foot board 42 or to the base 12. The leg panel second section 26 can be movable relative to the base 12 in a vertical direction. In some embodiments, the leg panel first section 25 has a shorter length $L_1$ (FIG. 2) than a length $L_2$ (FIG. 2) of the leg panel second section 26 (i.e., $L_1<L_2$). In other embodiments, the leg panel first section 25 has a length $L_1$ that is greater than or equal to a length $L_2$ of the leg panel second section 26 (i.e., $L_1 \geqq L_2$). When the patient support surface 18 is in a horizontal configuration to support a patient in a supine position, the leg panel first and second sections 25, 26 are in co-planar relationship as illustrated in FIG. 1.

Figure 3:
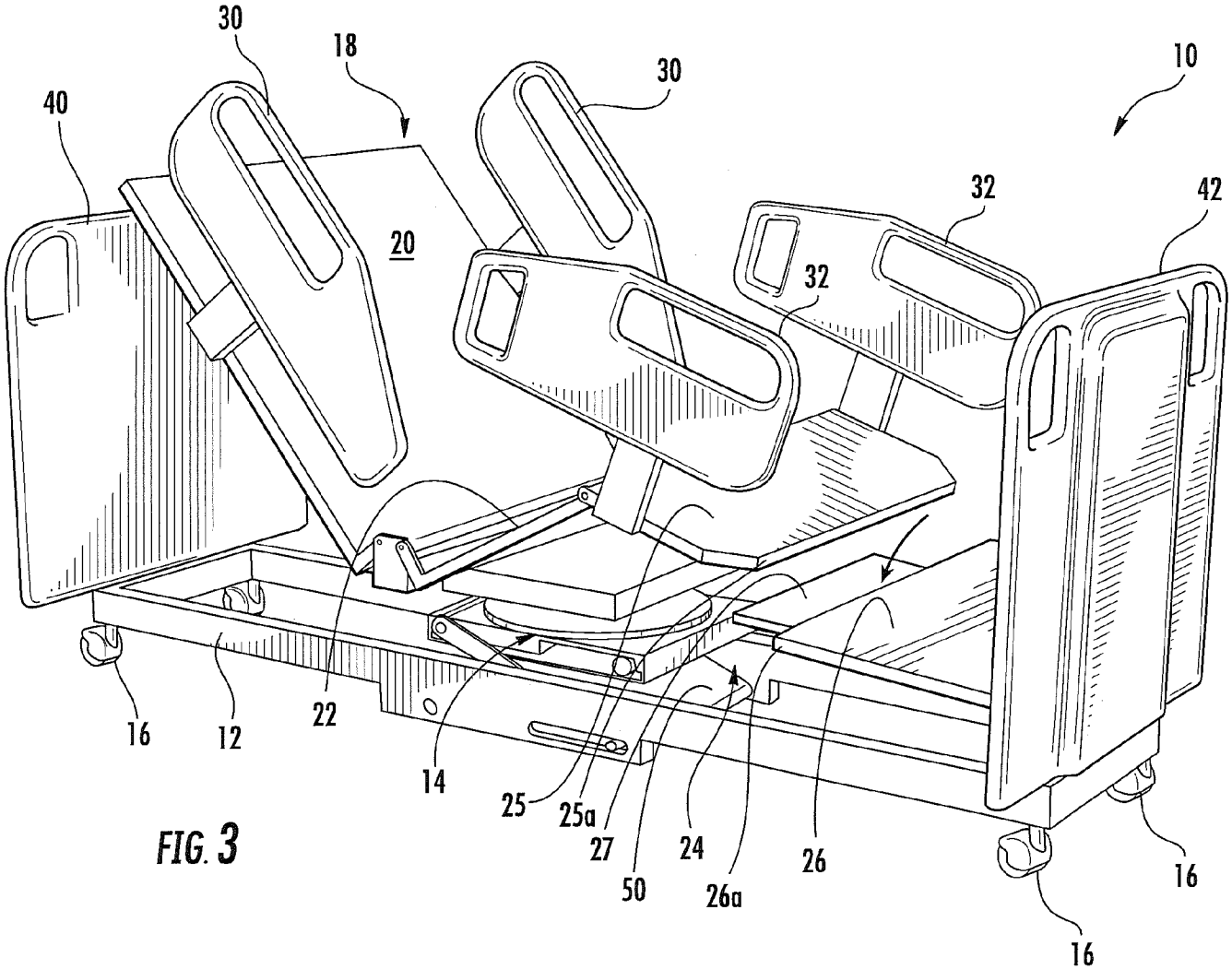
FIG. 3 is a side perspective view of the hospital chair bed shown in FIG. 2 with the leg panel first and second sections detaching from each other, according to some embodiments of the present invention.

As shown in FIG. 3, the leg panel second section 26 can have a tongue portion 27 extending outwardly from the free end 26*a* thereof. The leg panel first section 26 rests on the second section tongue portion 27 when the first and second sections 25, 26 are in coplanar relationship. The tongue portion 27 can have a thickness that is less than the thickness of the leg panel second section 26. The leg panel first section 25 can have a thickness that is substantially equivalent to the difference between the thickness of the leg panel second section 26 and the tongue portion 27. Accordingly, when the first and second sections 25, 26 are in coplanar relationship as illustrated in FIG. 1, the first and second sections 25, 26 are substantially flush relative to each other. However, embodiments of the present invention are not limited to the illustrated configuration of the first and second sections 25, 26. For example, in other embodiments of the present invention, the respective end portions 25*a* and 26*a* of the leg panel first and second sections 25, 26 may be configured to be in adjacent, end-to-end, spaced-apart relationship when the patient support surface 18 is in a horizontal configuration.

In other embodiments, the leg panel first section 25 can have a tongue portion extending outwardly from the free end thereof. The leg panel second section may be configured to rest on the first section tongue portion when the first and second sections 25, 26 are in coplanar relationship. In other embodiments, other releasably attachable mechanisms and configurations can be used with respect to the leg panel first and second sections 25, 26, including spaced-apart longitudinal guide rails and cooperating arms, etc.

Leg panel first and second sections 25, 26 can have various configurations. Embodiments of the present invention are not limited to the illustrated configuration of the leg panel first and second sections 25, 26.

Figure 2:
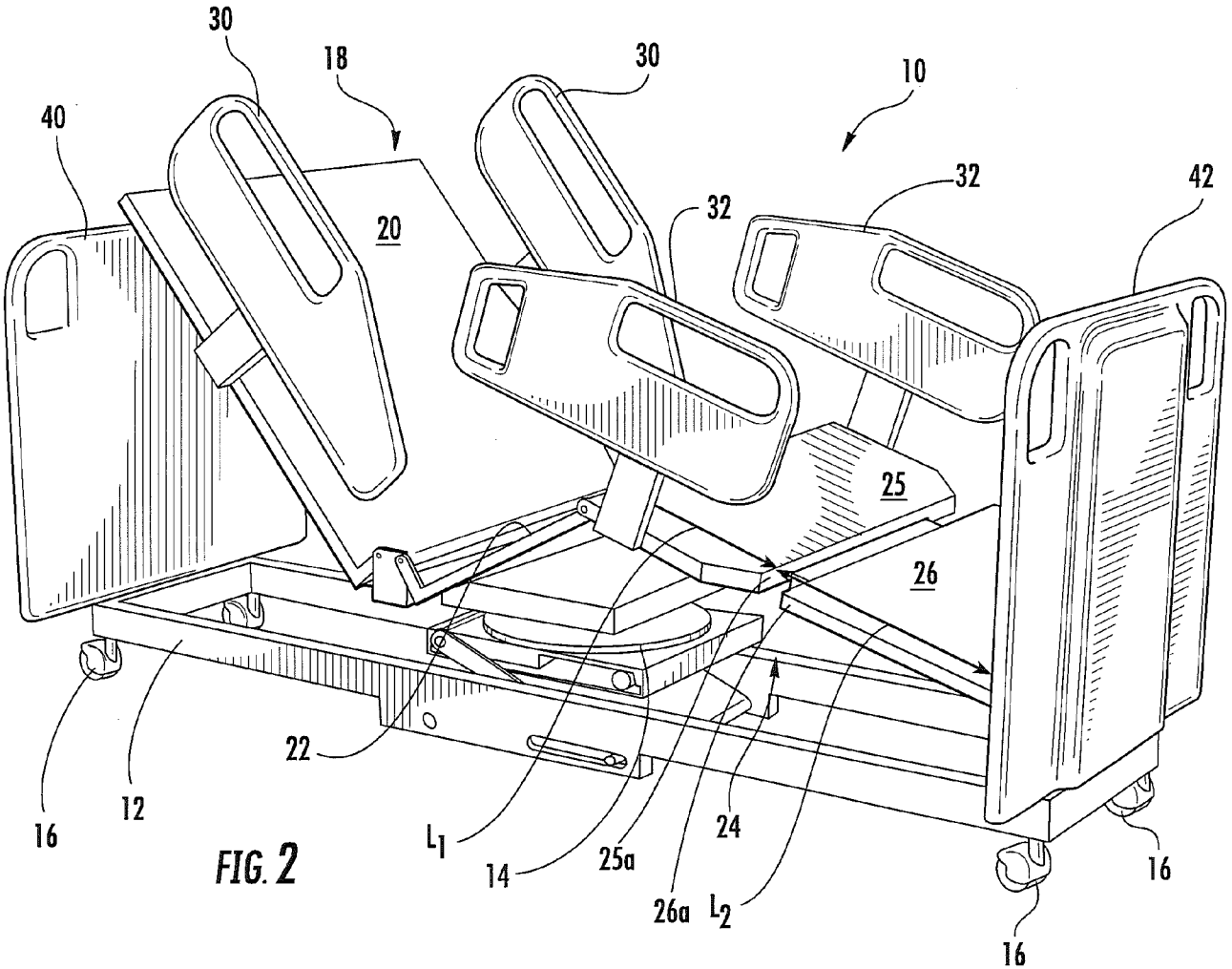
FIG. 2 is a side perspective view of the hospital chair bed shown in FIG. 1 with the back panel, seat panel, and leg panel of the patient support surface being articulated relative to each other as the bed is being converted to the chair configuration, according to some embodiments of the present invention.
Figure 4:
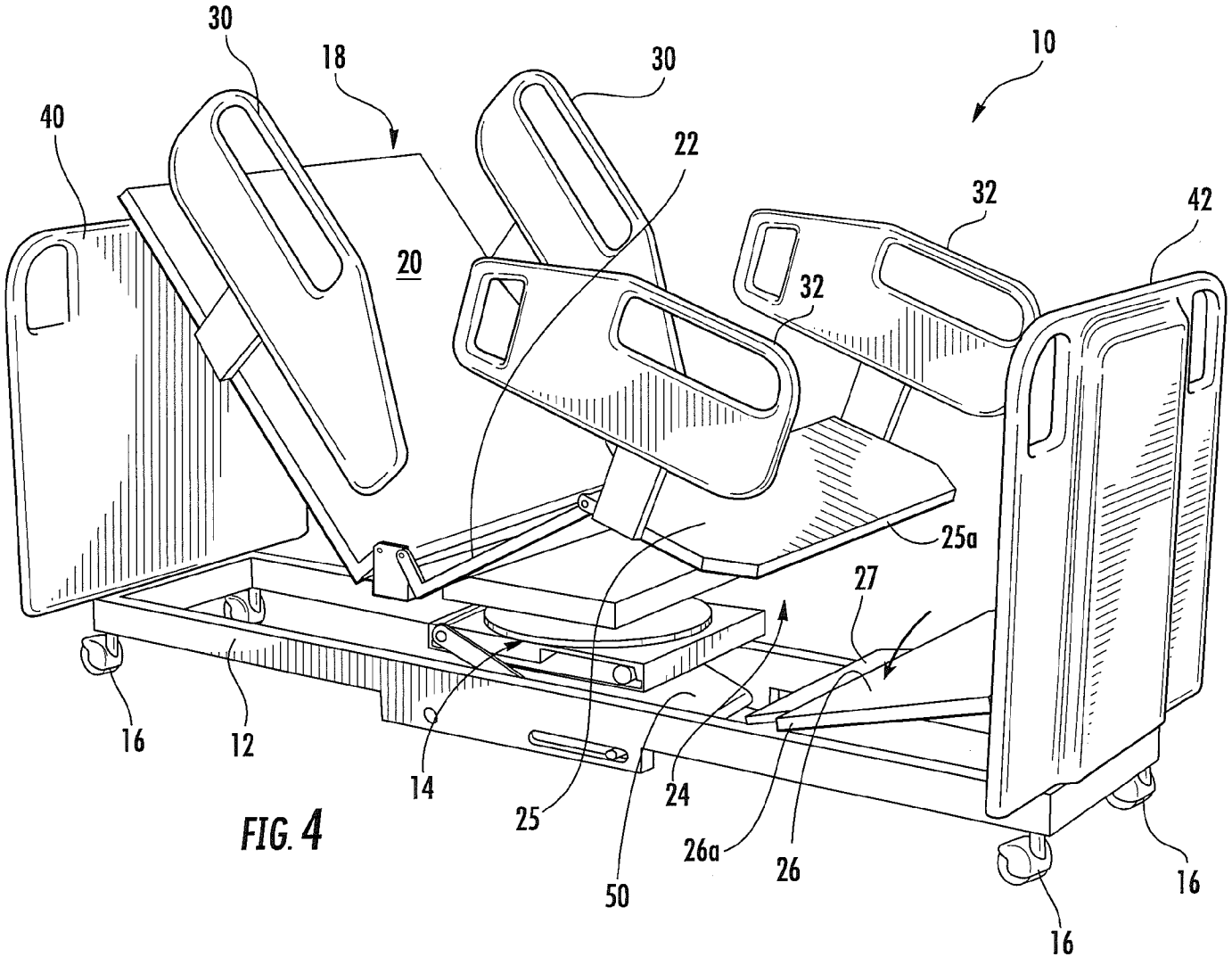
FIG. 4 is a side perspective view of the hospital chair bed shown in FIG. 3 with the leg panel second section pivoting downwardly away from the patient support surface and with the back panel, seat panel, and leg panel first section continuing to articulate relative to each other, according to some embodiments of the present invention.
Figure 9:
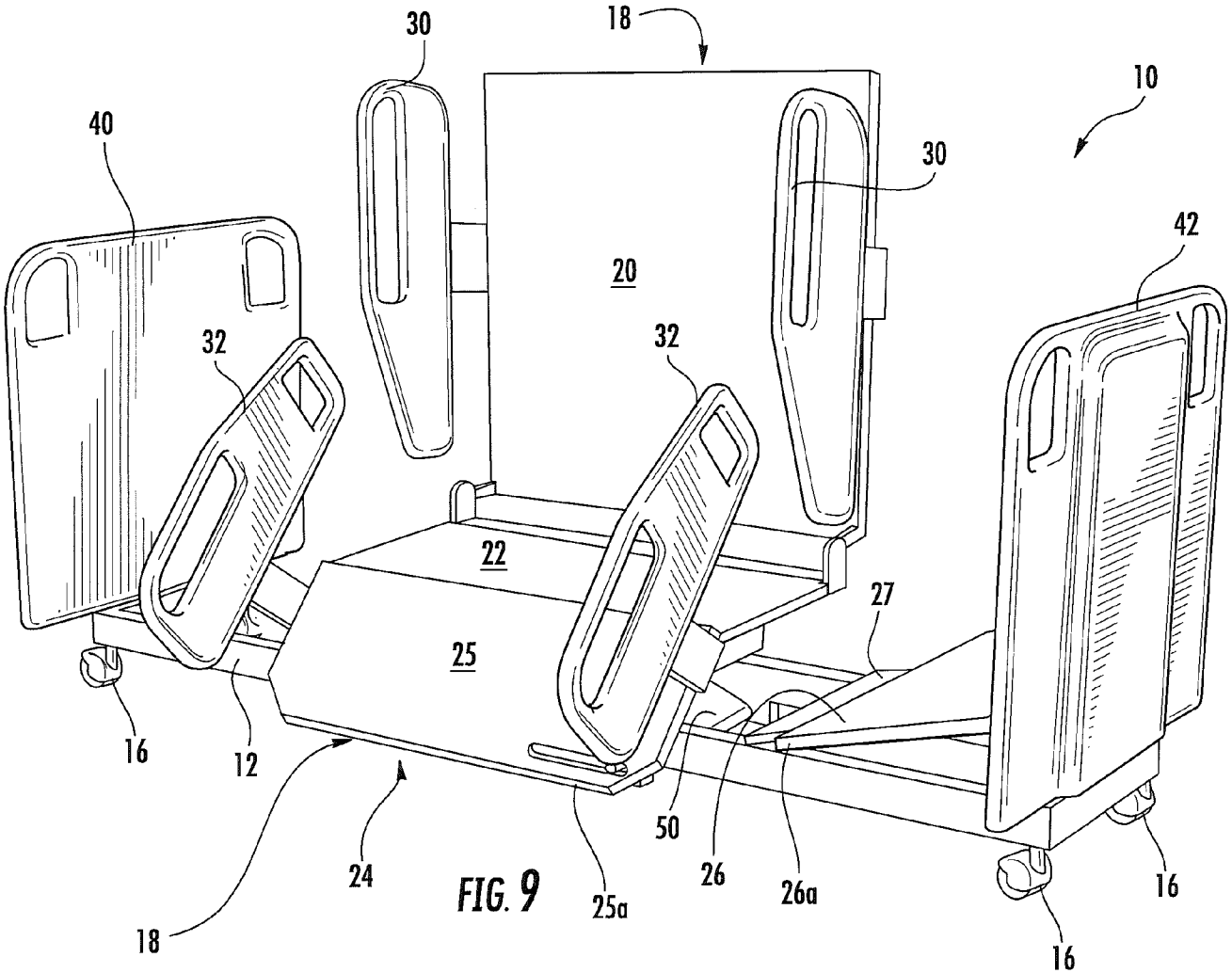

In operation, the bed 10 of the present invention typically has the back panel 20, seat panel 22, and leg panel 24 in a horizontal configuration as shown in FIG. 1, to support a patient in a supine position. To convert the bed 10 to a chair configuration, the back panel 20, seat panel 22 and leg panel 24 articulate relative to each other as shown in FIG. 2, for example by an actuator (e.g., pneumatic or hydraulic cylinder or other suitable mechanism). Specifically, as shown in FIGS. 3 and 4, the back panel 20 and seat panel 22 pivot relative to each other to form an upwardly facing V-shape while the leg panel 24 and seat panel 22 pivot relative to each other in a downwardly facing V-shape. The back panel 20 and the seat panel 22 can pivot relative to each other until they are substantially orthogonal to each other, as illustrated in FIG. 9. As the leg panel first section 25 pivots upwardly relative to the seat panel 22, the leg panel first section 25 slides away from the leg panel second section 26 (FIG. 3). The leg panel second section 26 slides downwardly relative to the base 12 and then pivots out of the way of the leg panel first section 25, while remaining attached to the leg board 42, as illustrated in FIGS. 3 and 4.

Figure 5:
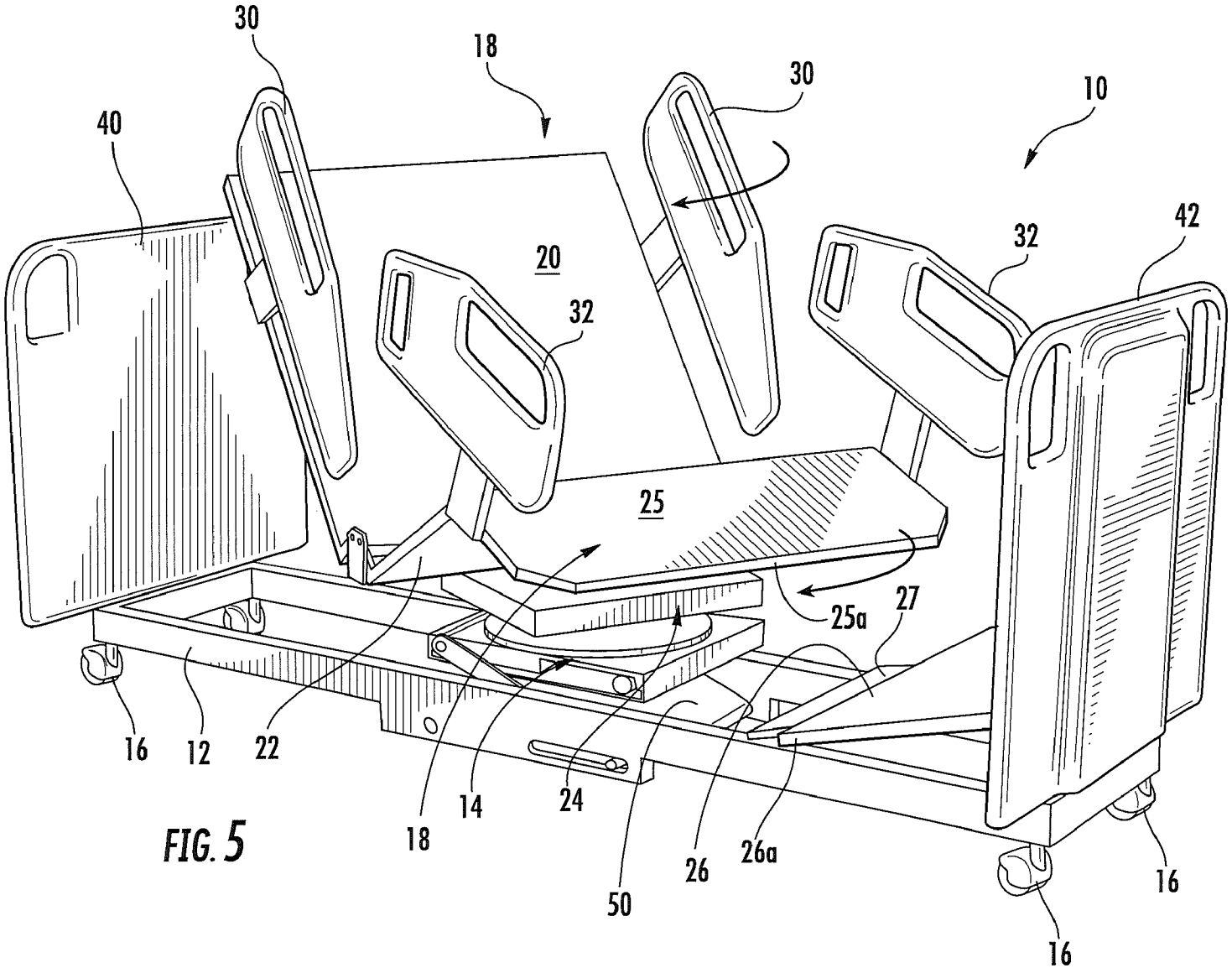
FIGS. 5-7 are side perspective views of the hospital chair bed shown in FIG. 4 with the patient support surface in various stages of rotation from the orientation of FIG. 4 ninety degrees (90°) to the side egress orientation of FIG. 7, according to some embodiments of the present invention.
Figure 6:
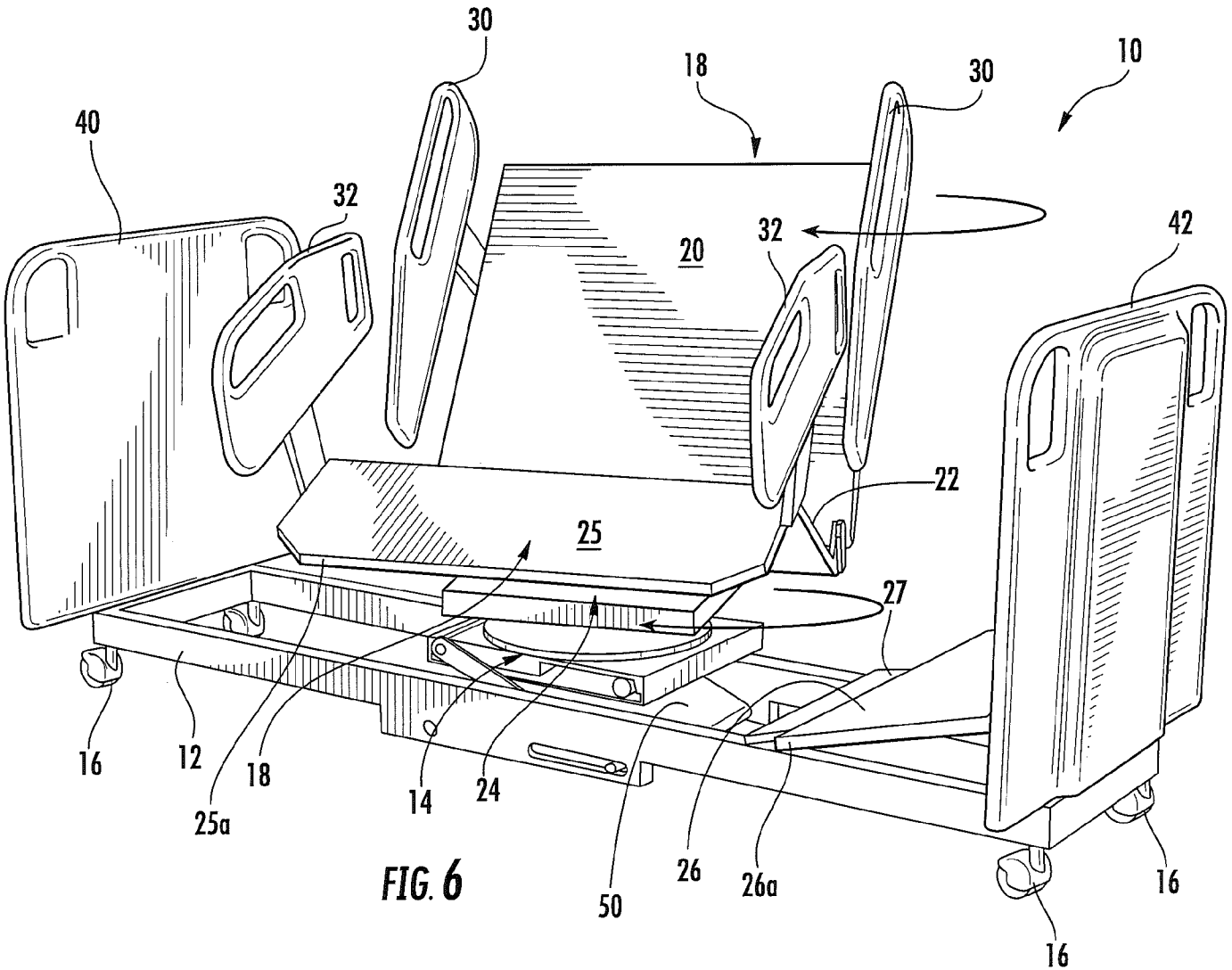
Figure 7:
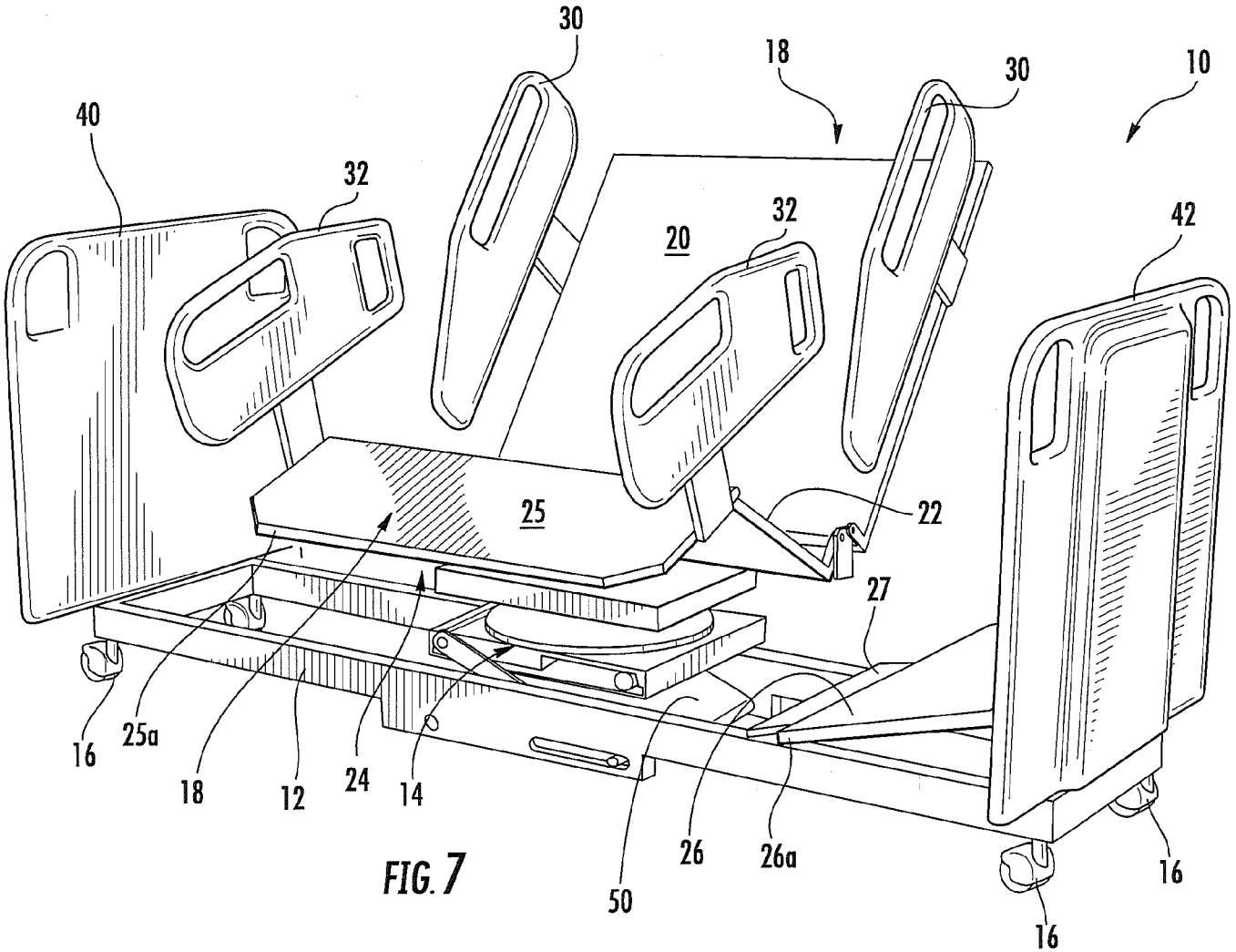
Figure 8:
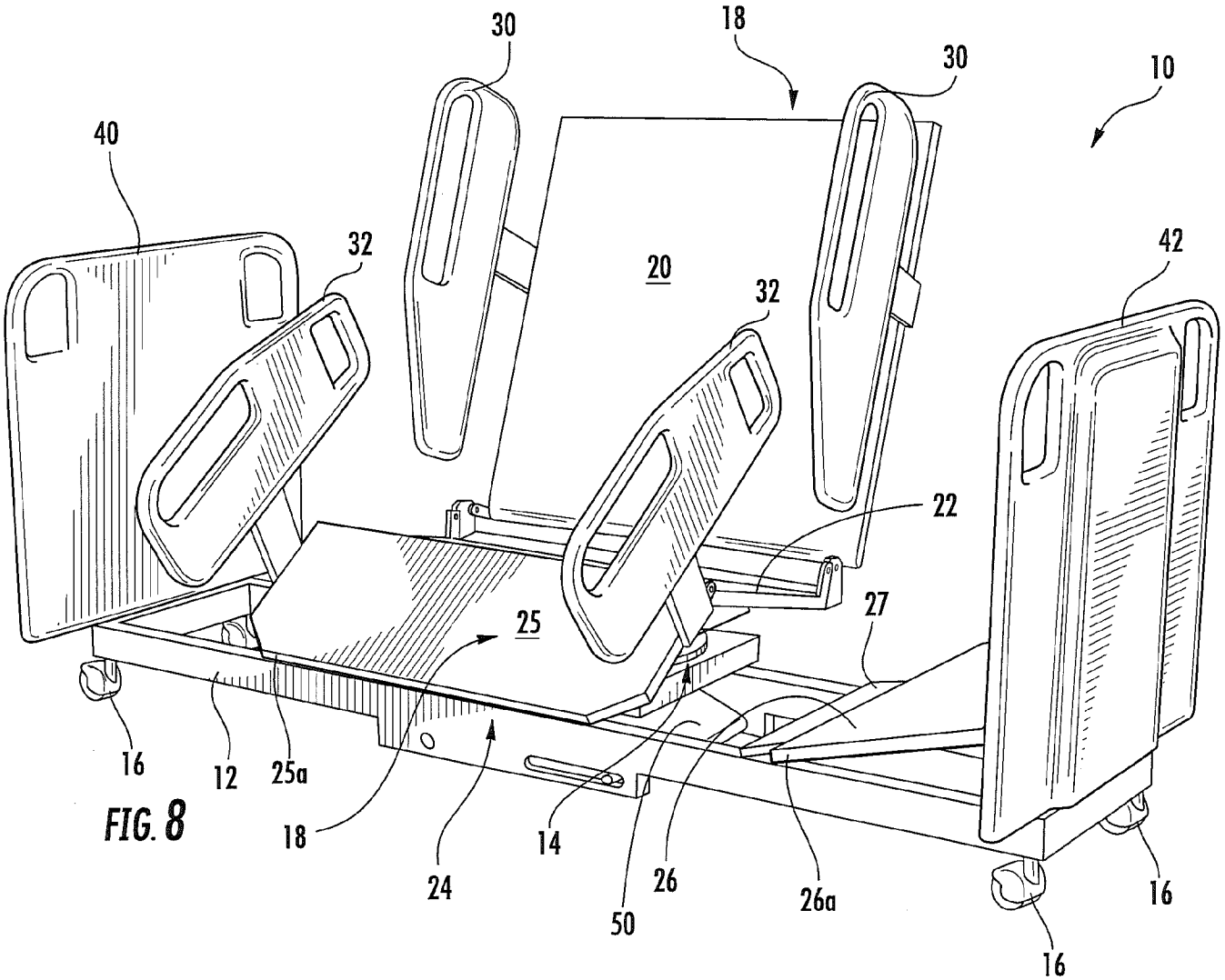
FIGS. 8-9 are side perspective views of the hospital chair bed shown in FIG. 7 with the articulated patient support surface being tilted as a unit until the seat panel is substantially horizontal (FIG. 9), according to some embodiments of the present invention.

Once the leg panel second section 26 pivots downwardly and out of the way, the articulated patient support surface 18 (now comprised of back panel 20, seat panel 22, and leg panel first section 25) is rotated approximately ninety degrees (90°) to permit side egress from the bed 10, as illustrated in FIGS. 5-7. The articulated patient support surface 18 can then be tilted as a unit, as illustrated in FIGS. 8-9, until the seat panel 22 is substantially horizontal (FIG. 9). At this point, the back panel 20 may be substantially vertical.

Figure 10:
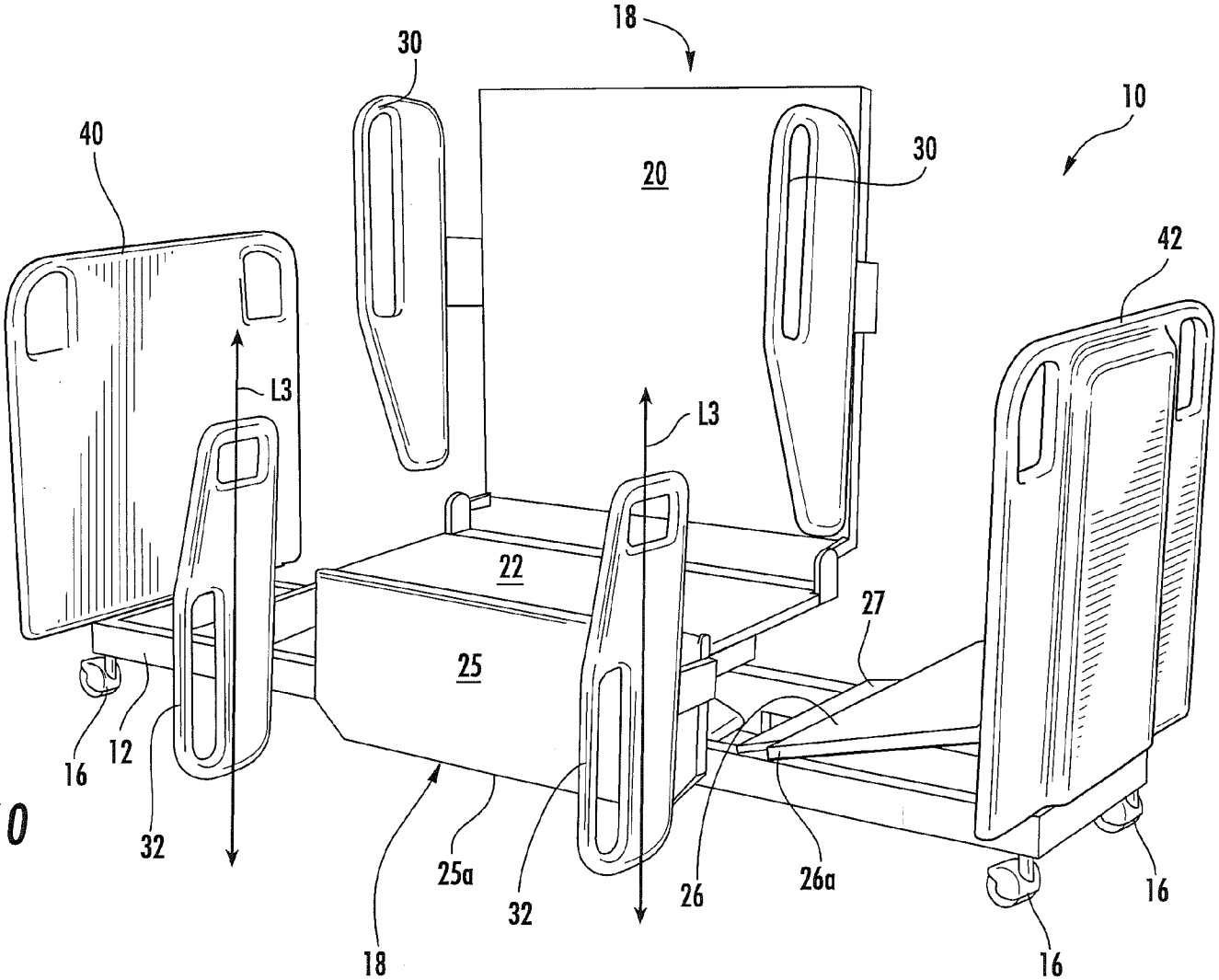
FIG. 10 is a side perspective view of the hospital chair bed shown in FIG. 9 with the leg panel first section pivoted to a substantially vertical orientation, according to some embodiments of the present invention.
Figure 11:
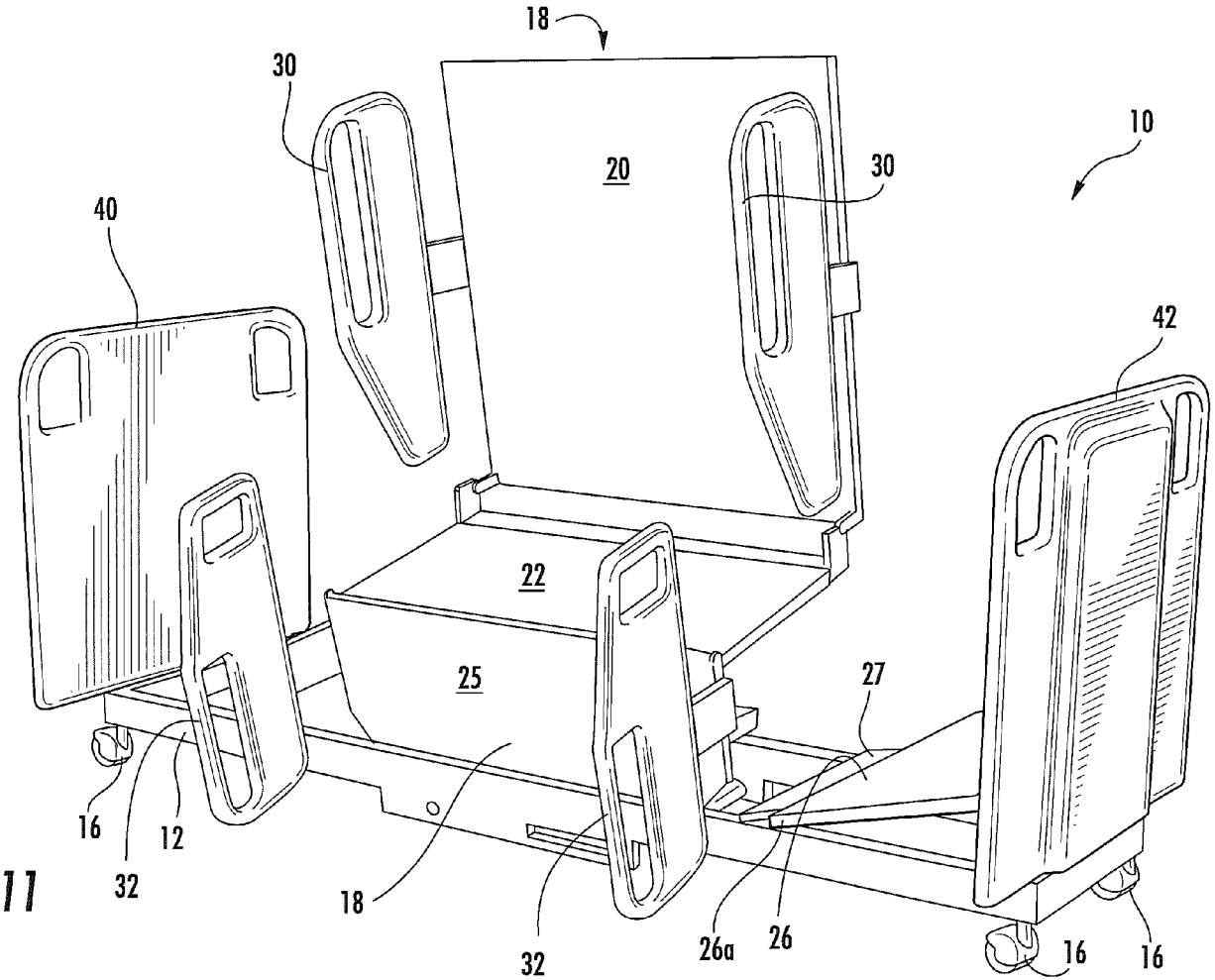
FIG. 11 is a side perspective view of the hospital chair bed shown in FIG. 10 with the patient support surface raised and tilted forward to facilitate patient egress from the support surface, according to some embodiments of the present invention.
Figure 12:
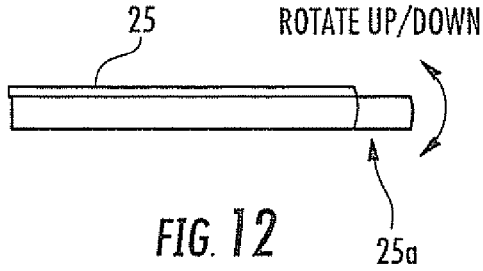
FIG. 12 is a side view of a leg panel first section, according to some embodiments of the present invention.

The leg panel first section 25 is then pivoted relative to the seat panel 22 until the first section 25 is substantially vertical, as illustrated in FIG. 10. The side rails 32, which can be secured to the leg panel first section 25, rotate with the leg panel first section 25 and are oriented such that a longitudinal direction thereof $L_3$ is substantially vertical (FIG. 10). The side rails 32 can be configured to be used as support handles to help a patient stand up from a sitting position on the support surface 18. The patient support surface 18 may then be raised and tilted forward via the lift mechanism 50, as illustrated in FIG. 11, to facilitate patient egress from the support surface 18 (e.g., a "stand-assist" orientation). Rotation, elevation, and tilting of the patient support surface 18 may be accomplished via one or more motors connected to various linkages, hydraulic cylinders, air cylinders, air bags, and/or other electrical devices, etc., and to the lift mechanism 50, as would be understood by those skilled in the art of the present invention.

Referring now to FIGS. 12-23, other embodiments of the present invention are illustrated. In the illustrated embodiments of FIGS. 12-23, the leg panel second section 26 is removed from the leg panel first section 25 manually. In some embodiments, the leg panel first section 25 has a length (e.g., about 11 inches) that is shorter than a length (e.g., about 17 inches) of the leg panel second section 26. However, it is understood that leg panel first and second sections 25, 26 can have various lengths according to embodiments of the present invention and are not limited to a particular length. Leg panel first section 25 is hingedly connected to the seat panel 22 via a pair of joints 25*a* (FIG. 12) on opposite sides of the leg panel first section 25.

The leg panel second section 26 is connected to the leg panel first section 25 via a pair of connector rods 110 and receiving tubes 100 that will be described in detail below. When the leg panel first and second sections 25, 26 are attached to each other, the patient support surface 18 is able to go to all the standard positions except the chair position. For transitioning to a chair position, the leg panel second section 26 is manually disconnected and removed from the leg panel first section 25.

Figure 13:
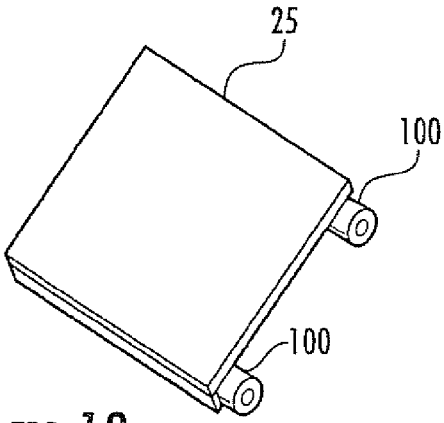
FIG. 13 is a top perspective view of the leg panel first section of FIG. 12, according to some embodiments of the present invention.
Figure 14:
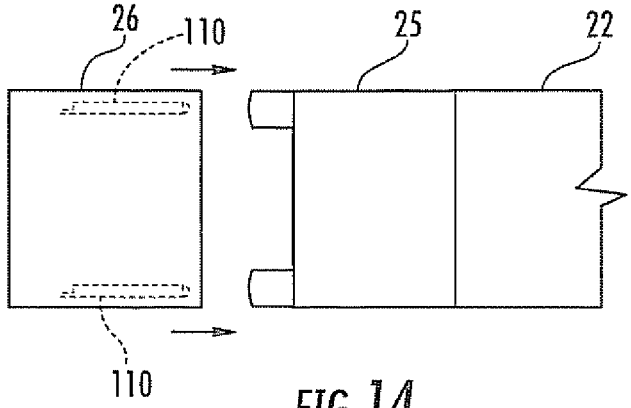
FIG. 14 is a top plan view of a portion of a patient support surface illustrating the leg panel first section of FIG. 12 and a leg panel second section, according to some embodiments of the present invention.
Figure 15:
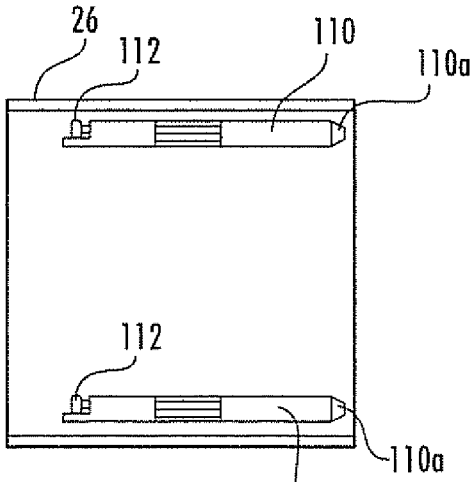
FIG. 15 is a bottom plan view of the leg panel second section of FIG. 14, according to some embodiments of the present invention.
Figure 16:
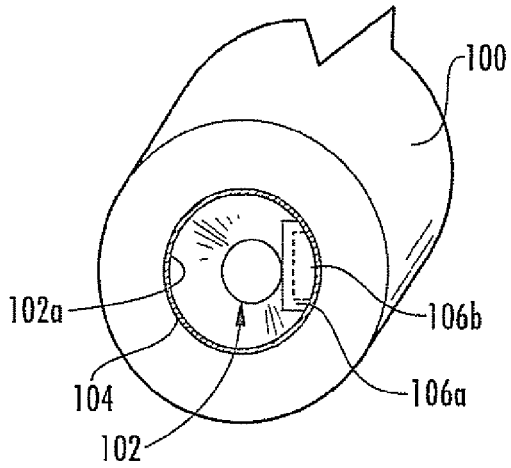
FIG. 16 is an enlarged partial perspective view of the end portion of a receiving tube utilized in releasably securing the leg panel first and second sections of FIG. 14 together, according to some embodiments of the present invention.

Referring to FIGS. 13-14 and 16, the leg panel first section 25 includes a pair of receiving tubes 100, as illustrated. The receiving tubes 100 are configured to receive and releasably secure a pair of connector rods 110 that are attached to the leg panel second section 26. As illustrated in FIG. 14, the receiving tubes 100 extend outwardly from the end of the leg panel first section 25, and the connector rods 110 secured to the bottom of the leg panel second section 26 (FIG. 15) do not extend outwardly past the end of the leg panel second section 26.

Each receiving tube 100 includes a channel 102 that terminates at a respective opening 104 in the end of the receiving tube 100, as illustrated in FIG. 16. The depth of each channel 102, in some embodiments, is about 3 inches and includes two spring-loaded teeth 106*a*, 106*b* (FIGS. 16 and 19) operably secured to the wall 102*a* of the channel 102. The teeth 106*a*, 106*b* are urged radially inward toward the axis of the channel by one or more springs 107 (FIG. 19) or other biasing mechanism(s). Teeth 106*a*, 106*b* are configured to engage a connector rod 110 inserted within the tube channel 102 as described below.

Figure 17:
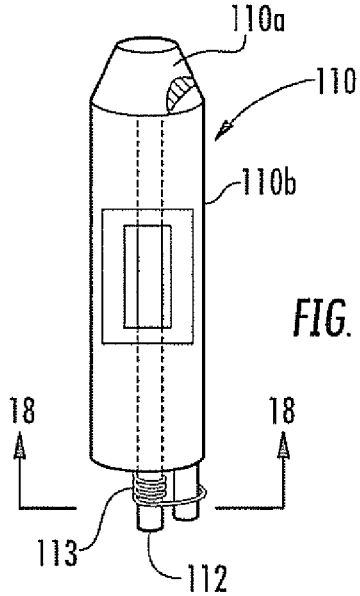
FIG. 17 is an enlarged partial perspective view of the end portion of a connector rod utilized in releasably securing the leg panel first and second sections of FIG. 14 together, according to some embodiments of the present invention.
Figure 18:
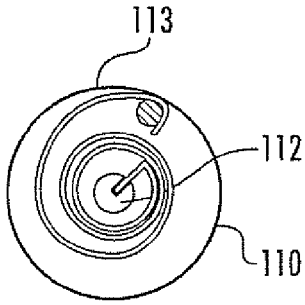
FIG. 18 is a cross sectional view of the connector rod of FIG. 17 taken along lines 18-18.
Figure 19:
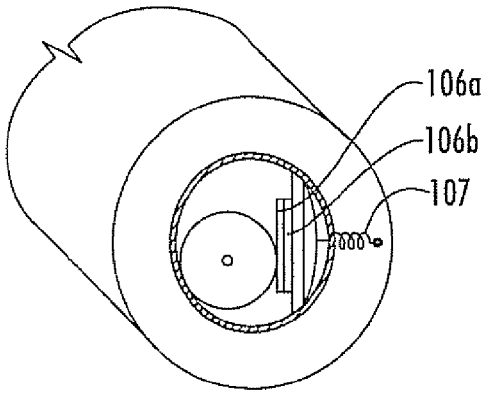
FIG. 19 is an enlarged partial perspective view of the end portion of a receiving tube utilized in releasably securing the leg panel first and second sections of FIG. 14 together, according to some embodiments of the present invention.
Figure 21:
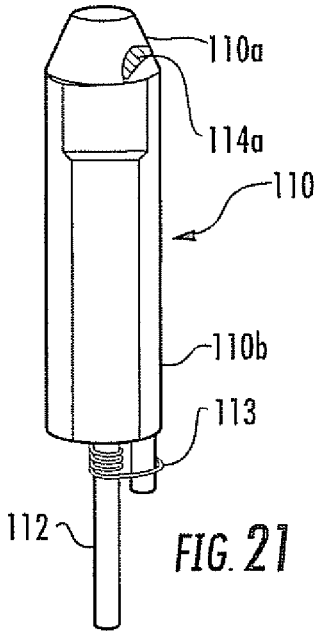
FIG. 21 is an enlarged partial perspective view of the end portion of a connector rod utilized in releasably securing the leg panel first and second sections of FIG. 14 together, according to some embodiments of the present invention.
Figure 20:
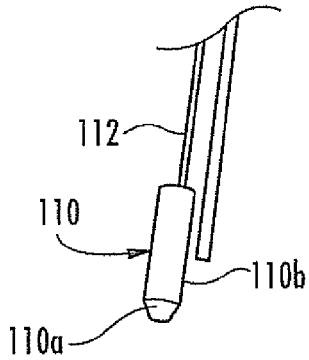
FIG. 20 is an enlarged partial perspective view of a connector rod utilized in releasably securing the leg panel first and second sections of FIG. 14 together, according to some embodiments of the present invention.

Referring to FIGS. 15, and 17-18, each connector rod 110 includes a cone-shaped distal end 110*a* that is configured to be inserted into a respective tube channel 102. The distal end 110*a* is cone-shaped to facilitate insertion into the tube channel 102. In some embodiments, the tube channel 102 may have a tapered or cone-shaped configuration that also facilitates insertion of a connector rod distal end 110*a* therein. The distal end 110*a* is rotatable relative to the main body portion 110*b* of the connector rod 110 via a smaller internal rod 112 that extends axially through the connector rod 110, as illustrated in FIGS. 17, 21 and 23.

Figure 23:
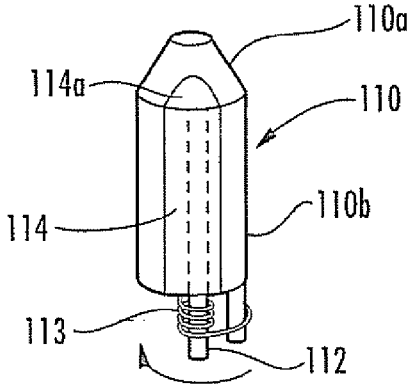
FIG. 23 is an enlarged partial perspective view of the end portion of the connector rod of FIG. 21 utilized in releasably securing the leg panel first and second sections of FIG. 14 together, according to some embodiments of the present invention.

Each connector rod body portion 110*b* and distal end 110*a* has a portion 114, 114*a* of the outer surface thereof with a flat configuration, as best illustrated in FIG. 23. When a connector rod 110 is inserted within a respective tube channel 102 and is engaged therein, the flat portions 114, 114*a* are not in alignment with each other. In other words, the connector rod 110 has the configuration illustrated in FIG. 21 when inserted within a tube channel 102. The flat portion 114*a* of the distal end 110*a* is rotatably offset from the flat portion 114 of the connector rod body portion 110*a* such that the teeth 106*a*, 106*b* engage the connector rod 110 and retain it within a respective tube channel 102.

Rotation of internal rod 112 by a user, however, will cause the distal end 11*a* to rotate and thereby cause the flat portions 114, 114*a* to become aligned, as illustrated in FIG. 23, which allows the connector rod 110 to be removed from a tube channel 102. The internal rod 112 is connected to a spring 113 (or other biasing mechanism) as illustrated in FIGS. 17, 21 and 23. When the internal rod 112 is rotated to rotate the distal end 110*a*, the spring 113 is configured to rotatably urge the rod 112 back to the initial position where the flat portions 114, 114*a* are not in alignment with each other. Rotation of the distal end 110*a* of the connector rod 110 via the internal rod 112 so as to align the flat portions 114, 114*a* is done to allow the connector rod 110 to become disengaged from the teeth 106*a*, 106*b* such that the connector rod 110 can be removed from the tube channel 102 and the leg panel second portion 26 can be removed from the leg panel first portion 25.

Figure 22:
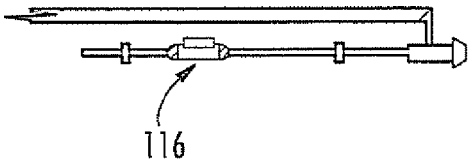
FIG. 22 is a side view of the leg panel second section of FIG. 14 illustrating a connector rod and handle for operating the connector rod of FIG. 21, according to some embodiments of the present invention.

FIG. 22 illustrates a handle 116 that may be associated with each internal rod 112 to facilitate rotation of the rod 112 and the connector rod distal end 110*a*. To connect the leg panel second section 26 with the leg panel first section 25, a user reaches under the leg panel second section 26 and rotates the internal rod 112 of each connector rod 110 via handle 116 to align the flat portions 114, 114*a*, as described above. Each connector rod 110 can then be inserted within a respective tube channel 102 on the leg panel first section 25. When the user releases the handle 116 associated with each connector rod 110, the connector rod distal end 110*a* rotates via spring 113 and the connector rod 110 becomes engaged with the teeth 106*a*, 106*b*. To remove the leg panel second section 26 from the leg panel first section 25, a user reaches under the leg panel second section 26 and rotates the internal rod 112 of each connector rod 110 via handle 116 to align the flat portions 114, 114*a*, which disengages each connector rod 110 from the teeth 106*a*, 106*b*. Each connector rod 110 can then be removed from the respective tube channel 102 on the leg panel first section 25.

Referring now to FIGS. 24-28, other embodiments of the present invention are illustrated. In the illustrated embodiments of FIGS. 24-28, the leg panel second section 26 is connected to and disconnected from the leg panel first section 25 automatically via an actuator, described below. In some embodiments, the leg panel first section 25 has a length (e.g., about 11 inches) that is shorter than a length (e.g., about 17 inches) of the leg panel second section 26. However, it is understood that leg panel first and second sections 25, 26 can have various lengths according to embodiments of the present invention and are not limited to a particular length. Leg panel first section 25 is hingedly connected to the seat panel 22 as described above.

Figure 24:
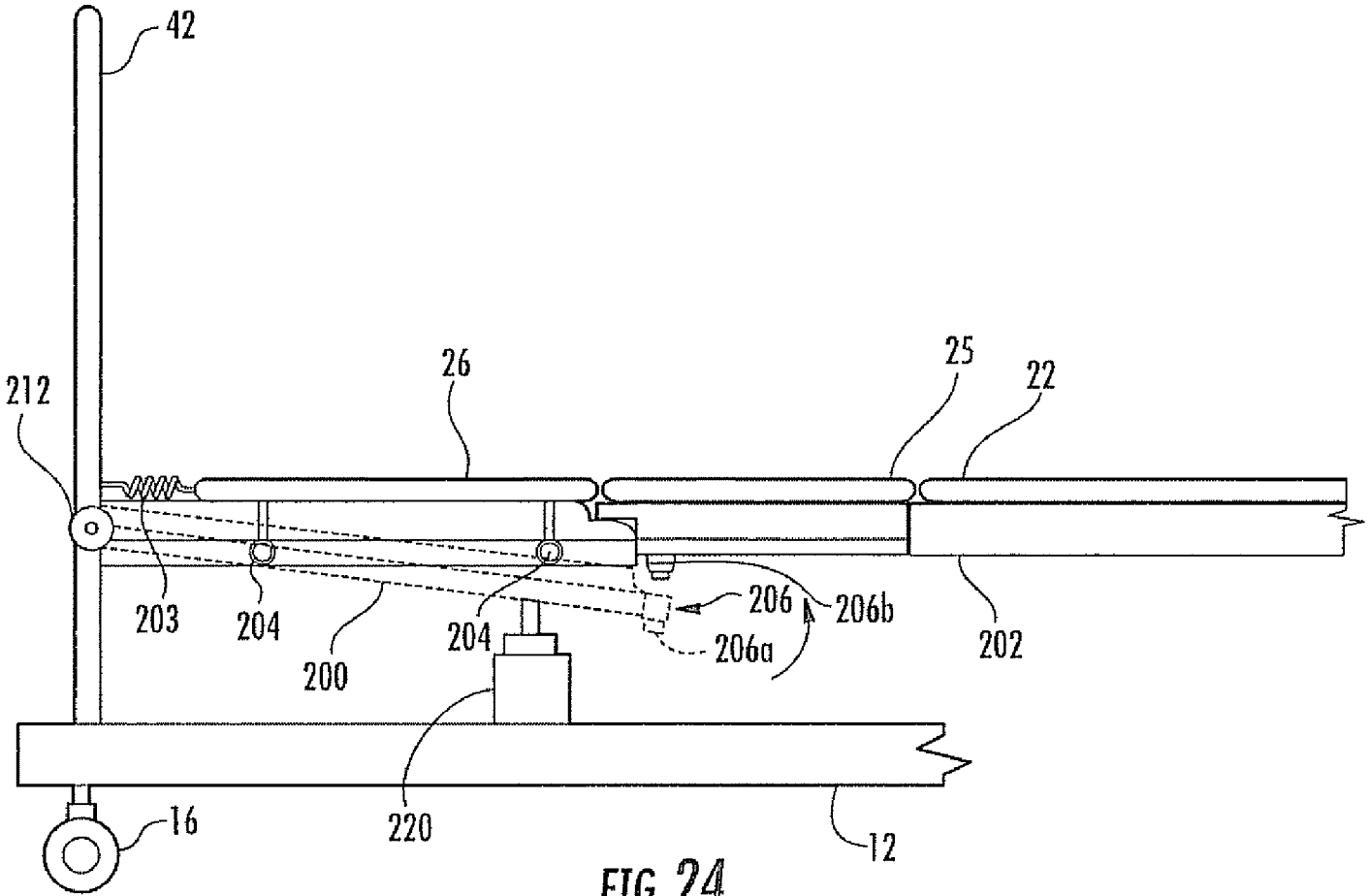
FIG. 24 is a partial side view of a hospital chair bed according to some embodiments of the present invention.

According to some embodiments of the present invention, a pair of spaced-apart rails 200 extend beneath the leg panel second section 26, as illustrated in FIG. 24. The rails 200 are movably attached at one end to the foot board 42. First and second pairs of rollers or cam followers 204 extend downwardly from the leg panel second section 26 and are engaged with rails 200. When the rails are pivoted, the cam followers 204 follow the movement of the rails 200 and facilitate smooth movement of the leg panel second section 26. One or more springs (or other biasing mechanisms) 203 are connected to the leg panel second section 26 and are configured to urge the leg panel second section 26 toward the leg panel first section 25 so as to maintain contacting relationship therewith.

In the illustrated embodiment, one portion 206*a* of a lock mechanism 206 is secured to one of the rails 200 (or between two spaced apart rails 200) and is configured to engage another portion 206*b* of the lock mechanism attached to the leg panel first section 25. An exemplary lock mechanism 206 is available from McMaster-Carr Supply Company, Robbinsville, N.J.

Figure 25:
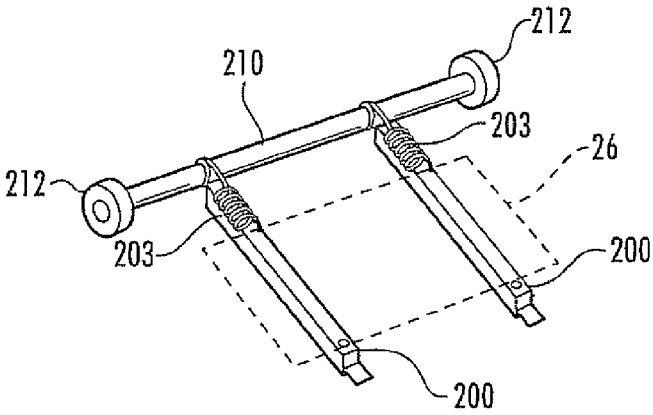
FIG. 25 is top perspective view of a pair of spaced-apart rails attached to a rolling rod that is utilized to movably secure a leg panel second section to a footboard of the hospital chair bed of FIG. 24, according to some embodiments of the present invention.
Figure 26:
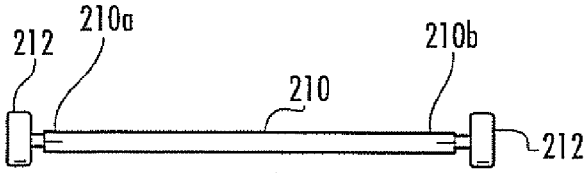
FIG. 26 is an elevation view of the rolling rod of FIG. 25.
Figure 27:
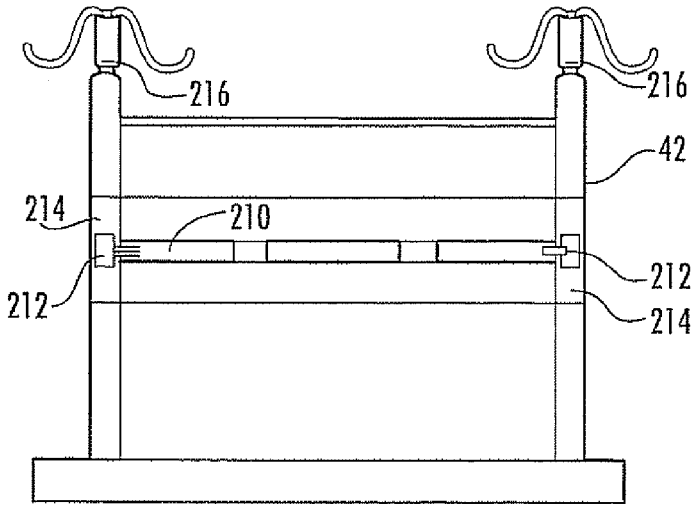
FIG. 27 is an end view of the footboard of the hospital chair bed illustrated in FIG. 25.

Referring to FIGS. 25-27, rails 200 are attached in spaced-apart relationship to a rolling rod 210. Rolling rod 210 includes a roller or cam follower 212 at each end 210*a*, 210*b*, as illustrated. Cam followers 212 are operably associated with track rails 214 in the footboard 42 and move upwardly and downwardly within these track rails 214. As such, the rails 200 can move upwardly and downwardly with respect to the footboard 42. In some embodiments, the track rails 214 are configured to accommodated IV poles 216.

Rolling rod 210 permits pivotal movement of the rails 200 relative to the footboard 42. Rails 200 and the various cam followers 204, 212 allow leg panel second section 26 to move with leg panel first section 25 as the patient support surface 18 is articulated to various positions, e.g., a cardiac chair position, etc. As illustrated in FIG. 24, an actuator 220 is configured to facilitate raising and lowering the patient support surface 18, as well as to allow the leg panel second section 26 to pivot down away from the leg panel first section 25 (FIGS. 3-4) such that the patient support surface 18 can be rotated to a side-egress position.

Figure 28:
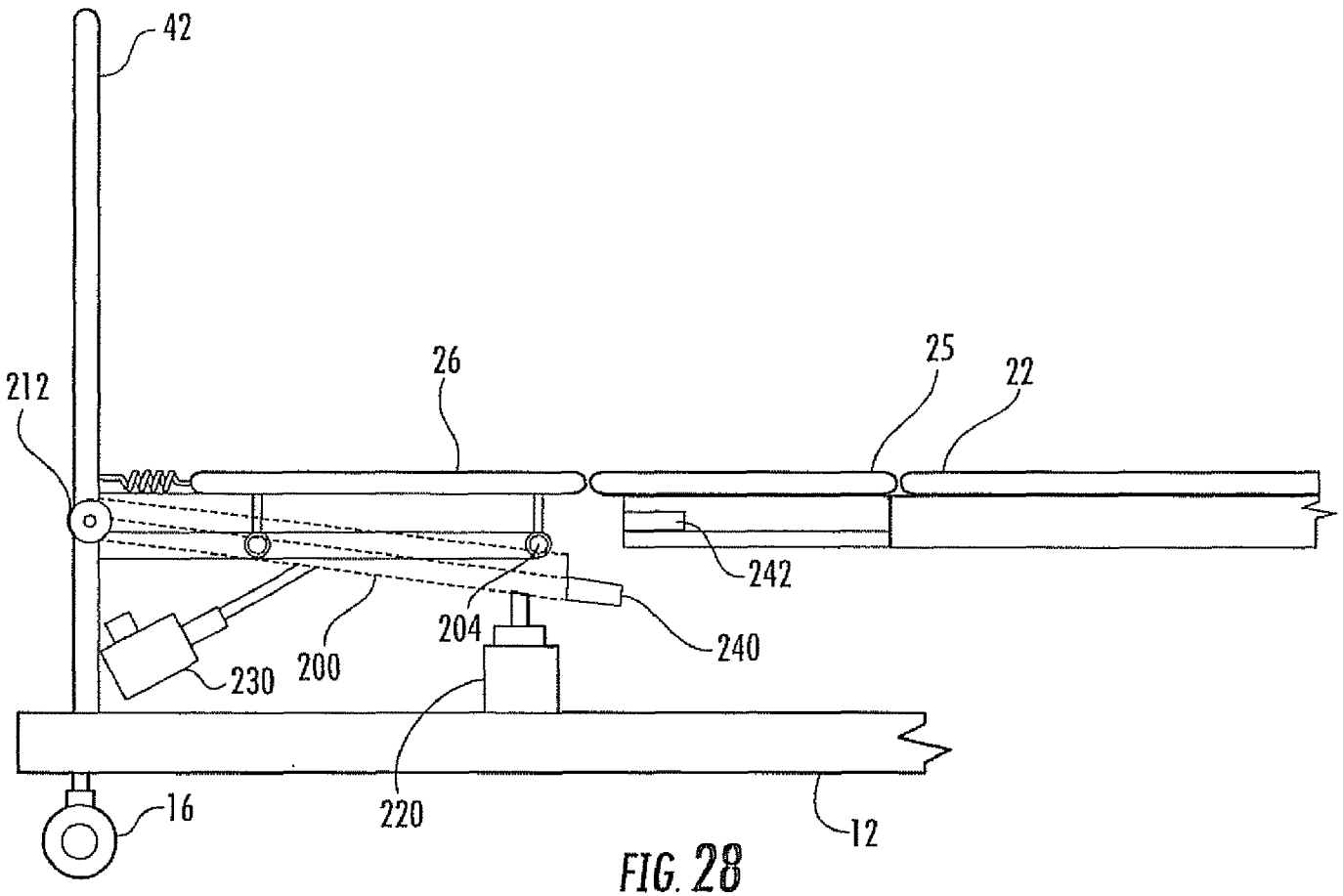
FIG. 28 is a partial side view of a hospital chair bed according to other embodiments of the present invention.

Referring now to FIG. 28, other embodiments of the present invention are illustrated. In FIG. 28, an actuator 230 is utilized to push and pull the leg panel section 26 relative to the leg panel first section 25. One or more rods 240 extend outwardly from the leg panel second portion 26 and are configured to be inserted within openings 242 to connect the first and second leg panel sections 25, 26, as illustrated. To unlock the leg panel second section 26 from the leg panel first section 25, the actuator 230 pulls the leg panel second section 26 away from the leg panel first section 25 and allows the leg panel second section 26 to be pivoted down and out of the way via actuator 220.

In the drawings and specification, there have been disclosed typical preferred embodiments of the invention and, although specific terms are employed, they are used in a generic and descriptive sense only and not for purposes of limitation, the scope of the invention being set forth in the following claims.

That which is claimed:

1. A hospital bed, comprising:

a base comprising opposite end portions;

a foot board secured to an end portion of the base;

a lifting mechanism secured to the base between the end portions;

a rotating frame mounted on the lifting mechanism, wherein the frame is configured to rotate about an axis that is substantially orthogonal to the base;

a patient support surface pivotally secured to the rotating frame, wherein the patient support surface comprises a back panel, a seat panel, and leg panel configured to articulate relative to each other from a co-planar configuration to a chair configuration, wherein the leg panel comprises a first section pivotally connected to the seat panel and a second section that disconnects from the leg panel first section when the back panel, seat panel, and leg panel articulate relative to each other from the co-planar configuration, and wherein the leg panel second section is movably coupled to the foot board and pivots downwardly away from the leg panel first section when the leg panel second section disconnects from the leg panel first section.

2. The hospital bed of claim 1, wherein the support surface when articulated is configured to translate rotate to a side-egress chair configuration.

3. The hospital bed of claim 1, wherein the lifting mechanism is configured to raise and lower the patient support surface relative to the base.

4. The hospital bed of claim 1, wherein the lifting mechanism comprises a scissors lift.

5. The hospital bed of claim 1, wherein the leg panel first and second sections have respective first and second lengths, and wherein the first length is less than the second length.

6. The hospital bed of claim 1, wherein the leg panel first and second sections have respective first and second lengths, and wherein the first length is greater than or equal to the second length.

7. The hospital bed of claim 1, further comprising a pair of side rails, each side rail movably mounted to a respective side portion of the back panel, wherein each side rail is movable between raised and lowered positions relative to the back panel.

8. The hospital bed of claim 1, further comprising a pair of side rails, each side rail movably mounted to a respective side portion of the leg panel first section, wherein each side rail is movable between raised and lowered positions relative to the leg panel first section.

9. The hospital bed of claim 1, further comprising a first pair of side rails and a second pair of side rails longitudinally spaced apart from the first pair of side rails, wherein each side rail is movably mounted to the bed with the first pair residing on opposing sides of the back panel and the second pair residing on opposing sides of the leg section, with the second pair configured to reside substantially vertically when the bed is in the side-egress chair configuration.

10. The hospital bed of claim 1, wherein the articulated support surface is configured to translate to a stand-assist configuration whereby the seat panel is tilted downward at about 30 degrees while the back panel is substantially vertical.

11. A hospital bed, comprising:

a base comprising opposite end portions;

a foot board secured to an end portion of the base;

a lifting mechanism secured to the base between the end portions;

a rotating frame mounted on the lifting mechanism, wherein the frame is configured to rotate about an axis that is substantially orthogonal to the base;

a patient support surface pivotally secured to the rotating frame, wherein the patient support surface comprises a back panel, a seat panel, and leg panel configured to articulate relative to each other from a co-planar configuration to a chair configuration, wherein the leg panel comprises a first section pivotally connected to the seat panel and a second section that disconnects from the leg panel first section when the back panel, seat panel, and leg panel articulate relative to each other from the co-planar configuration, wherein the leg panel second section is movably coupled to the foot board and pivots downwardly way from the leg panel first wherein when the leg panel second section disconnects from the leg panel first section, and wherein the articulated support surface is configured to rotate to a side-egress chair configuration; and a first pair of side rails and a second pair of side rails longitudinally spaced apart from the first pair of side rails, wherein each side rail is movably mounted to the bed with the first pair residing on opposing sides of the back panel and the second pair residing on opposing sides of the leg panel first section, with the second pair configured to reside substantially vertically when the bed is in the side-egress chair configuration.

12. The hospital bed of claim 11, further comprising a foot board secured to an end portion of the base, and wherein the leg panel second section is movably coupled to the foot board and is configured to pivot downwardly away from the leg panel first section.

13. The hospital bed of claim 11, wherein the lifting mechanism is configured to raise and lower the patient support surface relative to the base.

14. The hospital bed of claim 11, wherein the lifting mechanism comprises a scissors lift.

15. The hospital bed of claim 11, wherein the leg panel first and second sections have respective first and second lengths, and wherein the first length is less than the second length.

16. The hospital bed of claim 11, wherein the leg panel first and second sections have respective first and second lengths, and wherein the first length is greater than or equal to the second length.

17. The hospital bed of claim 11, wherein the articulated support surface is configured to translate to a stand-assist configuration whereby the seat panel is tilted downward at about 30 degrees while the back panel is substantially vertical.

* * * * *

UNITED STATES PATENT AND TRADEMARK OFFICE

CERTIFICATE OF CORRECTION

PATENT NO. : 8,375,489 B2
APPLICATION NO. : 12/499896
DATED : February 19, 2013
INVENTOR(S) : Manouchehri It is certified that error appears in the above-identified patent and that said Letters Patent is hereby corrected as shown below:

On Title Page:
Item 75, Inventors:
Please correct inventor "Nikon Manouchehri, Charleston, SC (US)"
to read -- Nikou Manouchehri, Charleston, SC (US) --

In the Claims:
Column 10, Line 11: Please correct "is configured to translate rotate to"
to read -- is configured to rotate to --

Column 10, Line 67: Please correct "downwardly way from the"
to read -- downwardly away from the --

Signed and Sealed this
Thirteenth Day of August, 2013

Teresa Stanek Rea
*Acting Director of the United States Patent and Trademark Office*